US006969311B2

(12) United States Patent
Chen et al.

(10) Patent No.: US 6,969,311 B2
(45) Date of Patent: Nov. 29, 2005

(54) PNEUMATIC SANDING MACHINE

(75) Inventors: Chun-Tien Chen, Chiayi Hsien (TW); Pei-Chin Hung, Taichung (TW); Chin-Feng Liu, Miaoli Hsien (TW)

(73) Assignee: Soartec Co., Ltd., Taichung Hsien (TW)

( * ) Notice: Subject to any disclaimer, the term of this patent is extended or adjusted under 35 U.S.C. 154(b) by 189 days.

(21) Appl. No.: 10/695,073

(22) Filed: Oct. 28, 2003

(65) Prior Publication Data

US 2005/0020196 A1 Jan. 27, 2005

(30) Foreign Application Priority Data

Jul. 10, 2003 (TW) ..... 92212625 U

(51) Int. Cl.[7] ..... B24B 23/00; B24B 55/00; B24B 55/06

(52) U.S. Cl. ..... 451/359; 451/451; 451/456; 451/344; 451/357; 451/353; 409/137

(58) Field of Search ..... 451/359, 456, 451/451, 344, 357, 353; 83/100; 30/133, 30/390–391; 144/252.1, 252.2; 408/67, 137; 137/269, 270

(56) References Cited

U.S. PATENT DOCUMENTS

| | | | | |
|---|---|---|---|---|
| 3,820,558 | A * | 6/1974 | Mueller | 137/269 |
| 4,302,910 | A * | 12/1981 | Tschacher | 451/295 |
| 5,538,040 | A * | 7/1996 | Huber et al. | 137/614.19 |
| 5,919,085 | A * | 7/1999 | Izumisawa | 451/357 |
| 6,328,643 | B1 * | 12/2001 | Huber | 451/357 |
| 6,447,387 | B1 * | 9/2002 | Tseng | 451/456 |
| 2002/0111127 | A1 * | 8/2002 | Tseng | 451/358 |

* cited by examiner

*Primary Examiner*—David B. Thomas
*Assistant Examiner*—Bryan Muller
(74) *Attorney, Agent, or Firm*—William E. Pelton, Esq.

(57) ABSTRACT

A pneumatic sanding machine includes a body, a pneumatic motor assembly mounted in the body and a control valve detachably mounted in the body to change the path of compressed air that actuates the sanding machine. The control valve includes a first portion selectively closing one of different air passages in the body at a time, a second portion and a neck portion interconnecting the first portion with the second portion. Thus, a dust bag or a vacuum cleaner can be connected to the sanding machine to collect dust or sanding debris so that the sanding machine provides three different ways of dust collection, one of which is not to deal with the powder, the second is to collect the powder into a dust bag, and the third is to vacuum the powder into a vacuum cleaner.

7 Claims, 9 Drawing Sheets

PNEUMATIC SANDING MACHINE

BACKGROUND OF THE INVENTION

1. Field of the Invention

The present invention relates to a pneumatic sanding machine, and more particularly to a pneumatic sanding machine that has a control valve that changes movement of exhausting compressed air so that the sanding machine provides a selectable way of dealing with wood-dust or sanding debris caused during sanding.

2. Description of Related Art

Sanding machines, as known as sanders are used to smooth work-pieces, such as wood. A pneumatic sanding machine applies compressed air or pressurized air as a power to actuate the sanding machine working. When a person uses a pneumatic sanding machine to make something smooth, dust and debris will be produced by the sanding operation.

There are three operations introduced into the sanding machines in accordance with the prior art, one of which is not to deal with the dust, the second is to collect the dust into a dust bag and the third way is to vacuum the dust into a vacuum cleaner regarded as a central-aspirated feature. However, each of the stand-alone sanding machines in accordance with the prior art provides only one of the three operation ways to deal with the powder. None of the conventional sanding machines provides all three operation ways such that a person who is using the sanding machine can select a proper way to deal with the dust. Besides, the last two of the aforementioned operations for dealing with the dust involves a lot of parts assembled in the sanding machine and assembly of these parts into the sanding machine requires excessive time. Consequently, the conventional sanding machine is not only inconvenient to use but also involves uneconomic fabrication costs.

To overcome the shortcomings, the present invention provides a sanding machine having a control valve that changes a movement of exhausting compressed air so that a way to deal with the waste material is selectable to mitigate or obviate the aforementioned problems.

SUMMARY OF THE INVENTION

The main objective of the invention is to provide a sanding machine that has a control valve to change a movement of exhausting compressed air simply so as to have three selectable operation ways to deal with dust and debris caused by sanding. Another objective of the invention is to provide a sanding machine that has a simple control valve to change a movement of exhausting compressed air simply.

Other objectives, advantages and novel features of the invention will become more apparent from the following detailed description when taken in conjunction with the accompanying drawings.

DETAILED DESCRIPTION OF PREFERRED EMBODIMENT

Figure 1:
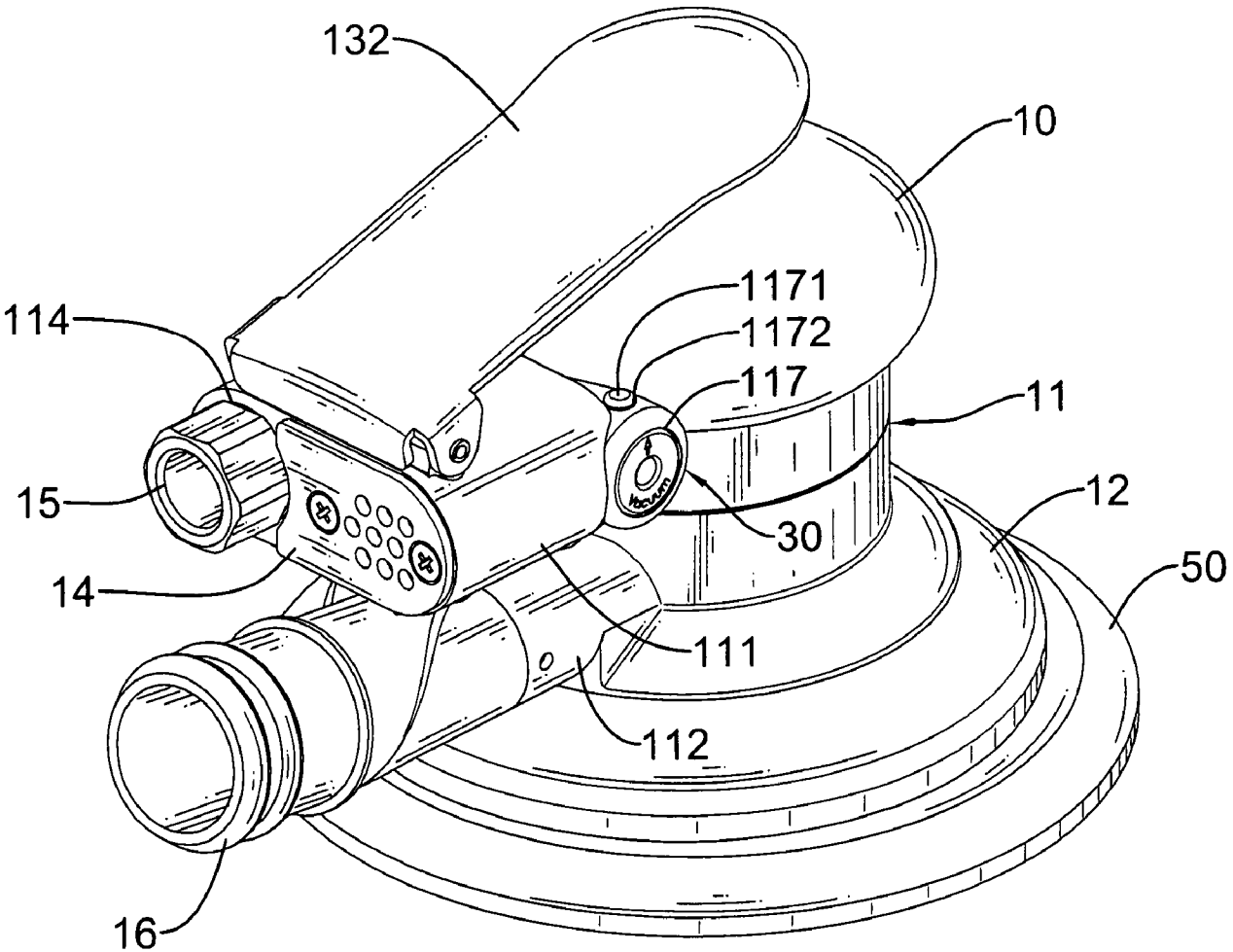
FIG. 1 is a perspective view of a sanding machine in accordance with the present invention.
Figure 2:
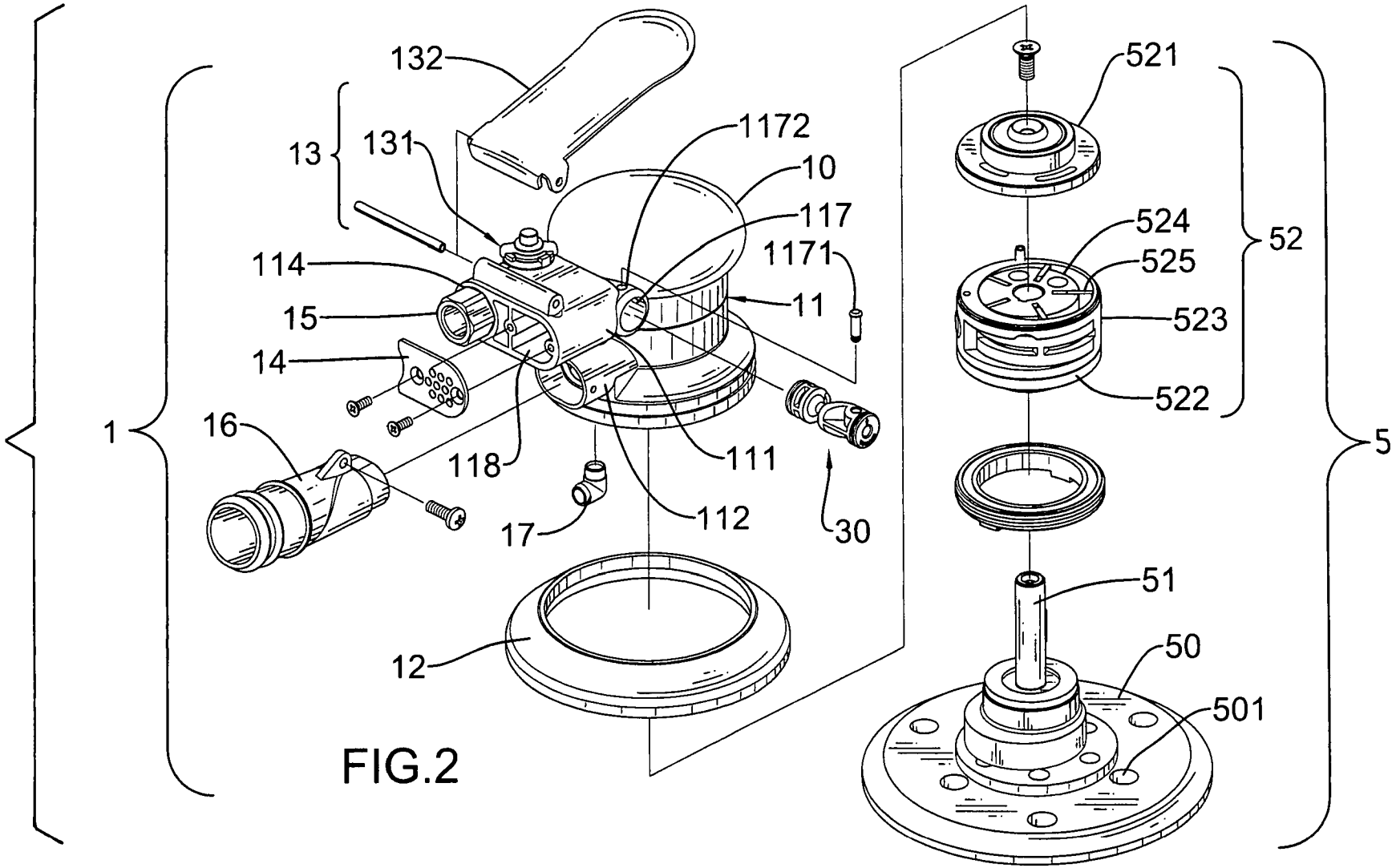
FIG. 2 is an exploded perspective view of the sanding machine in FIG. 1.

With reference to FIGS. 1 and 2, a sanding machine (not numbered) in accordance with the present invention comprises a body (1), a control valve (30) and a pneumatic motor assembly (5) that is assembled in a conventional manner in this art. The body (1) comprises a top cap (10), a motor frame (11), a bottom annular cover (12), a switch assembly (13), a chamber cover (14) and multiple connection fittings, such as an intake air connection fitting (15), a vacuum connection fitting (16) and an elbow connection fitting (17).

Figure 4:
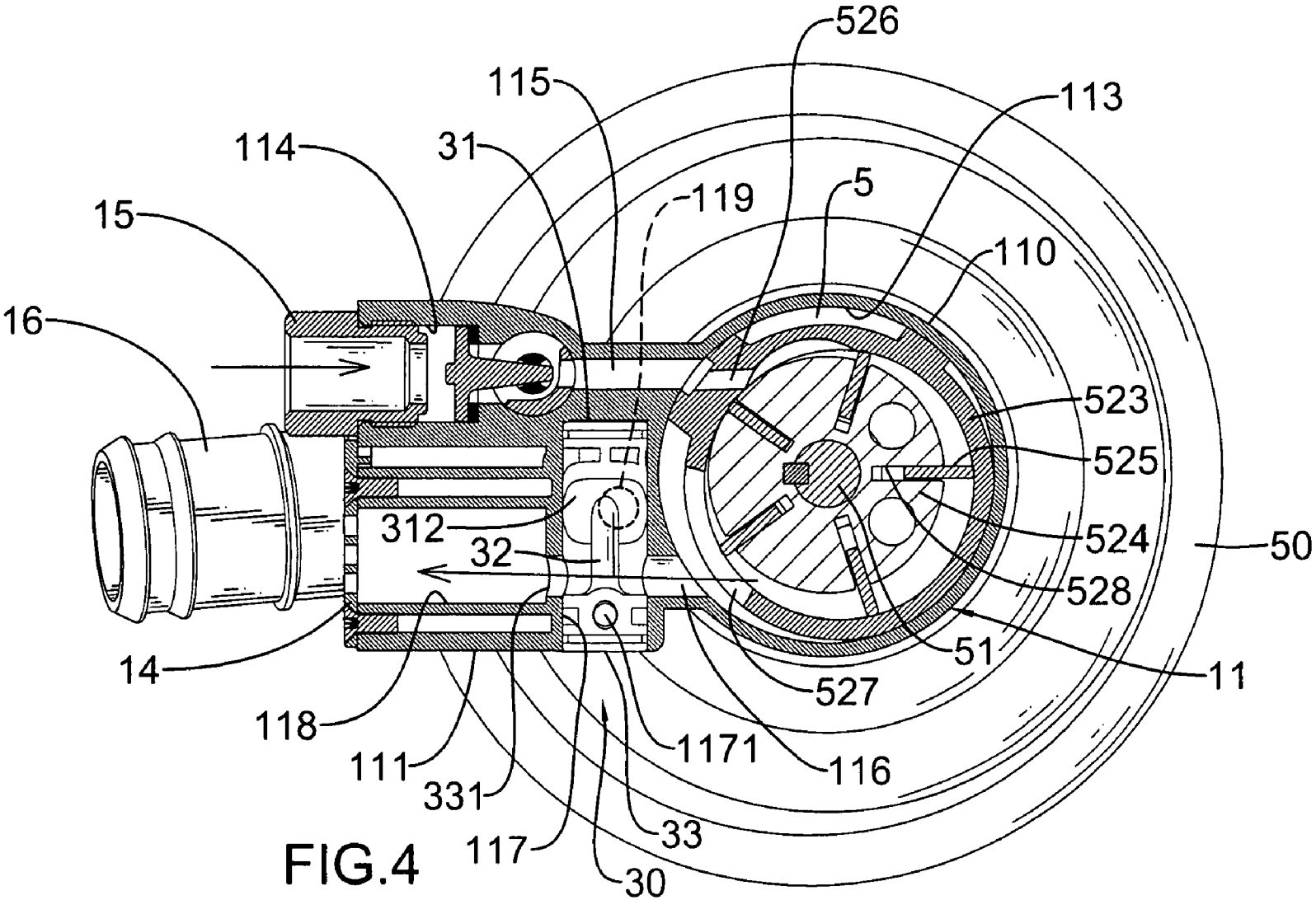
FIG. 4 is an operational, partial cross sectional top plan view of the sanding machine when the sanding machine is operated without a way of dealing with waste material.

With reference to FIGS. 2 and 4, the motor frame (11) has an annular portion (110), an upper protrusion (111) and a lower protrusion (112). The annular portion (110) has an exterior periphery (not numbered) and an inner space (113) with a top opening (not numbered) and a bottom opening (not numbered). The upper and the lower protrusions (111, 112) are integrally formed on and extend from the exterior periphery. The top cap (10) is attached to the annular portion (110) to cover the top opening of the inner space (113).

The upper protrusion (111) has a front (not numbered), a rear (not numbered), two opposite sides (not numbered), an intake air port (114), an intake air passage (15), an exhausted air passage (116), a valve chamber (117), a buffering chamber (118) and a connecting passage (119). The front of the upper protrusion (111) is formed integrally on the exterior periphery of the annular portion (110) of the motor frame (11). The intake air port (114) and the buffering chamber (118) are respectively defined in the rear of the motor frame (11). The intake air passage (115) is defined between the intake air port (114) and the annular portion (110), is aligned with the intake air port (114) and communicates with the inner space (113). Likewise, the exhausted air passage (116) is defined between the buffering chamber (118) and the annular portion (110) and communicates with the inner space (113). The chamber cover (14) covers the buffering chamber (118) and has multiple through holes (not numbered) to permit air to exit the buffering chamber (118).

The intake air connection fitting (15) is attached to and held in the intake air port (114) so that the sanding machine can connect conveniently to a compressed air source, such as an air compressor (not shown). The switch assembly (13) is mounted outside of the upper protrusion (111), interconnects the intake air port (114) with the intake air passage (115) and comprises a pneumatic switch (131) and a lever (132) pivotally mounted on the upper protrusion (111). Thus, when the lever (132) is pressed, the pneumatic switch (131)

will be actuated by the lever (132) to allow the compressed air to enter the intake air passage (115) via the intake air port (114).

The valve chamber (117) is defined transversally in one of the sides of the upper protrusion (111) and interconnects the exhausted air passage (116) with the buffering chamber (118). The control valve (30) is detachably mounted and held in the valve chamber (117) to change and control the exhausted air movement. In order to hold the control valve (30) in the valve chamber (117), a pin hole (1172) is defined longitudinally through the upper protrusion (111) and communicates with the valve chamber (117), thus a pin (1171) can be inserted into the pin hole (1172) to hold the control valve (30) in position.

Figure 6:
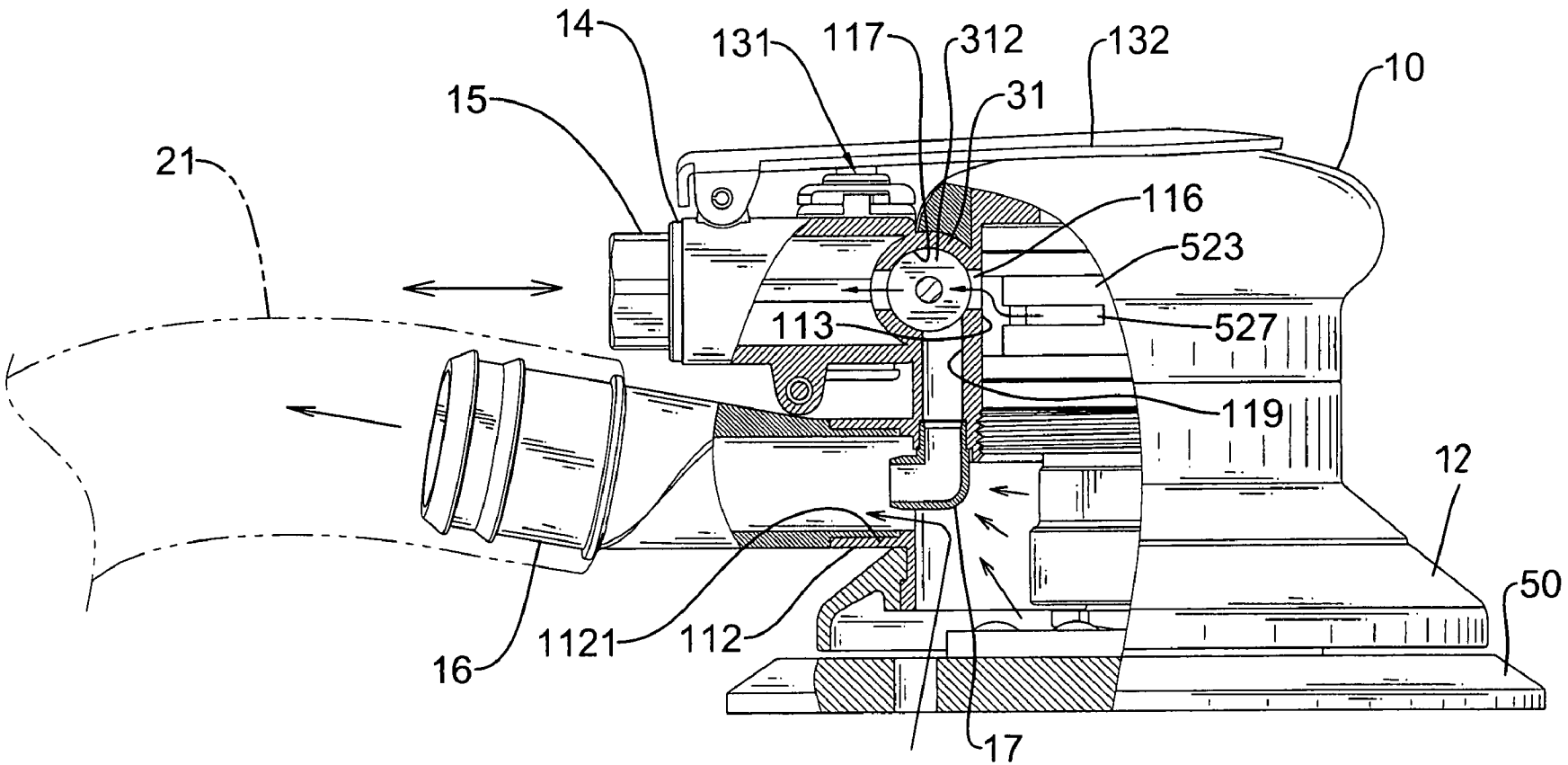
FIG. 6 is an operational, partial cross sectional side plan view of the sanding machine in FIG. 5.

With reference to FIG. 6, the connecting passage (119) is defined longitudinally in the valve chamber (117) and has a bottom opening (not numbered) that communicates with the bottom opening of the inner space (113). The elbow connection fitting (17) is fitted into the bottom opening of the connecting passage (119) and has an air outlet (not numbered). The lower protrusion (112) is formed integrally on the exterior periphery of the annular portion (110) and has an air exhausting passage (1121) aligned with the air outlet of the elbow connection fitting (17). The vacuum connection fitting (16) is inserted and held in the exhausting passage (1121) and is adapted to connect with either a vacuum cleaner (not shown) or a dust bag (not shown).

With reference to FIGS. 2 and 4, the motor assembly (5) is mounted and held partially in the inner space (113) in the motor frame (11) and comprises a sanding pad (50), a shaft (51) and a pneumatic motor (52). The sanding pad (50) is for a task of sanding with sanding papers (not shown) and has a top (not numbered) and multiple powder sucking holes (501) defined through the top. The powder sucking holes (501) are arranged radially and covered by the bottom annular cover (12) that is attached to the annular portion (110) of the motor frame (11). The shaft (51) extends from the top of the sanding pad (50), connects to the pneumatic motor (52) and is rotated by the pneumatic motor (52). The pneumatic motor (52) is assembled in a conventional manner and comprises a top cover (521), a bottom cover (522), a stator (523), a rotor (524) and multiple air-actuated blades (525). The stator (523) is mounted and held in the inner space (113) in the motor frame (11) and has a top (not numbered), a bottom (not numbered), a rotor space (not numbered), an air inlet (526) being aligned and communicating with the intake air passage (115) and an air outlet (527) communicating with the exhausted air passage (116). The rotor (524) is rotatably mounted in the rotor space of the stator (523), connects to the shaft (51) and has multiple blade slots (528) that holds respectively the air-actuated blades (525). The top and the bottom covers (521, 522) are respectively attached to the top and the bottom of the stator (523) to enclose the rotor space in the stator (523).

Figure 3:
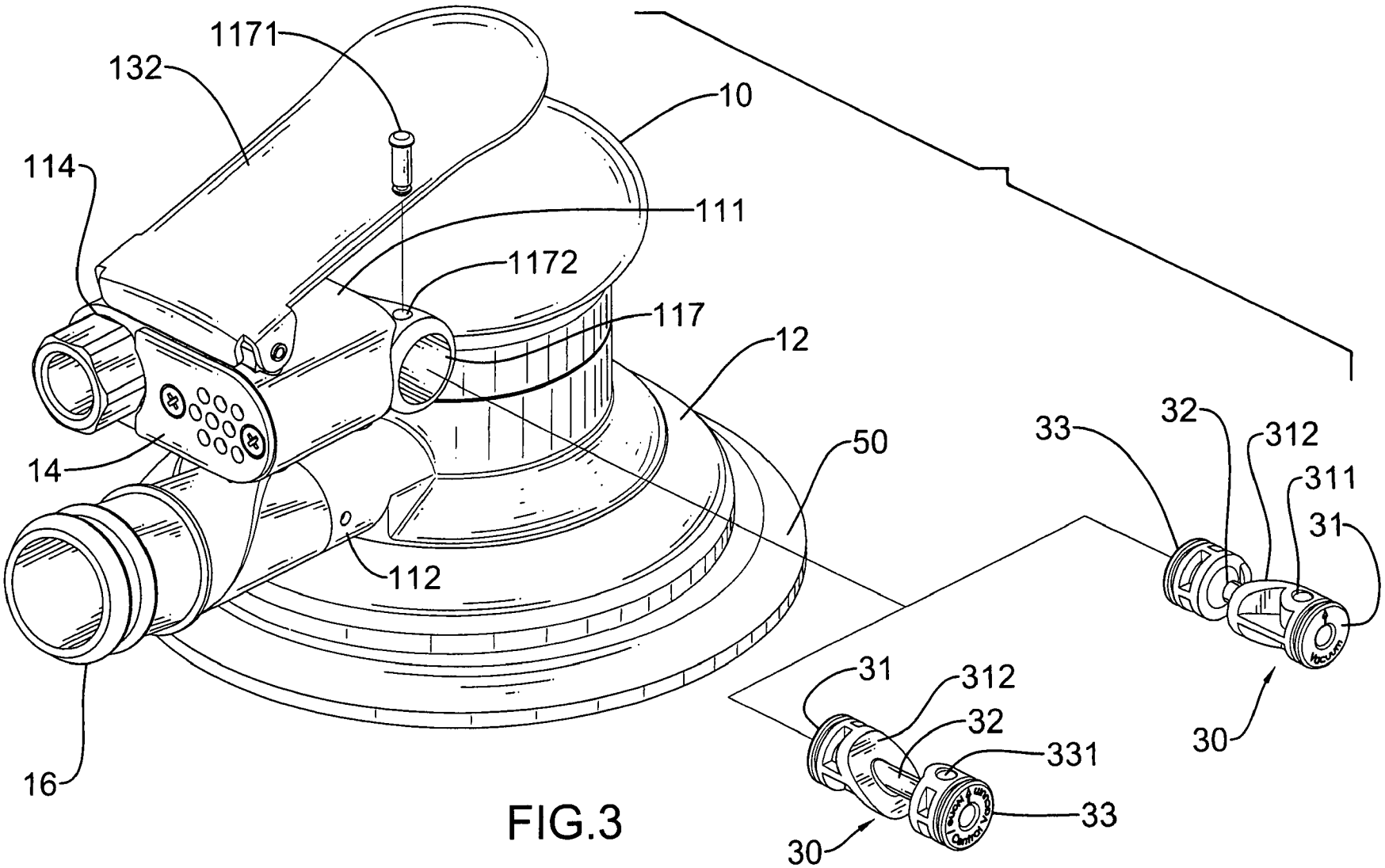
FIG. 3 is a partially exploded perspective view of the sanding machine in FIG. 1.

With reference to FIG. 3, the control valve (30) is detachably received in the valve chamber (117), has a first end (not numbered), a second end (not numbered) and comprises a first portion (31), a neck portion (32) and a second portion (33). The first portion (31) has a first positioning hole (311) defined radially and which corresponds selectively to the pin hole (1172), and an inclined surface (312) which forms an elongated covering protrusion (not numbered). The neck portion (32), which can be a cylinder, protrudes from the inclined surface (312) and connects to the second portion (33). The second portion (33) has a second positioning hole (331) defined radially and which corresponds selectively to the pin hole (1172).

With reference to FIG. 4, when the sanding machine is operated in one way without dealing with the waste material, the compressed air is only used to rotate the rotor (524). In such an operation model, the first portion (31) of the control valve (30) is inserted into the valve chamber (117) so that the elongated covering protrusion covers and closes the connecting passage (119). The pin (1171) is inserted into the pin hole (1172) and extends into the second positioning hole (331) to hold the control valve (30) in position. The leading arrows in FIG. 4 indicate the path and movement of the compressed air. The incoming compressed air flows through the intake air passage (115) entering the rotor space of the stator (523) via the air inlet (526) to actuate the rotor (524) to rotate. Then, the compressed air comes out of the rotor space through the air outlet (527), passes through the exhausted air passage (116) and over the neck portion (32) and enters the buffering chamber (118) that reduces the compressed air speed to avoid noise. The compressed air will eventually be exhausted via the through holes in the chamber cover (14).

Figure 5:
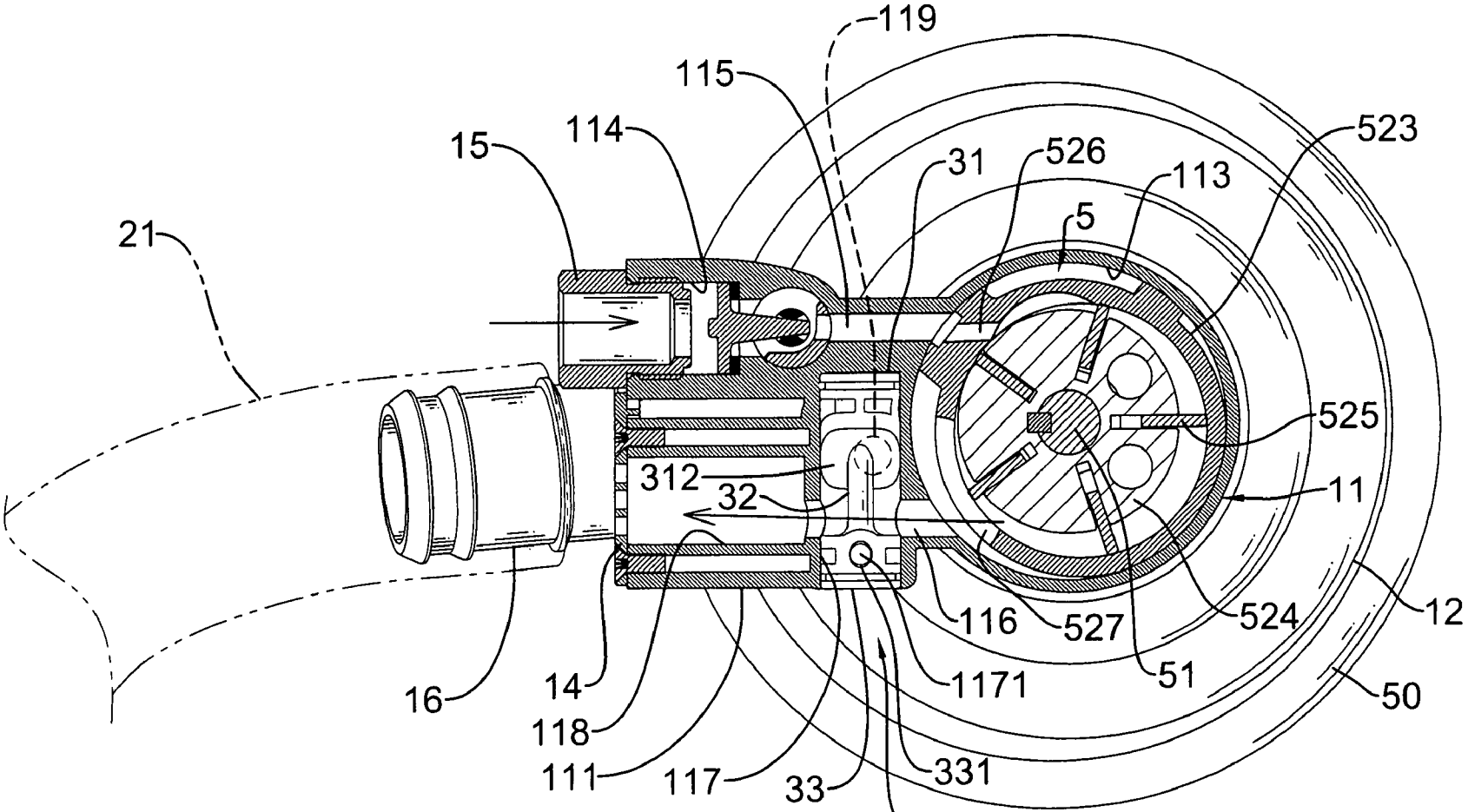
FIG. 5 is an operational, partial cross sectional top plan view of the sanding machine when the sanding machine is operated with a way of vacuuming the waste material into a vacuum cleaner.

With reference to FIGS. 3, 5 and 6, when the sanding machine as previously described in FIG. 4 has to be changed to a way of using the central-aspirated feature of the sanding machine that uses a vacuum cleaner (not shown) to vacuum the waste material, the vacuum cleaner connects to the vacuum connection fitting (16) by means of a connecting hose (21). Thus, the waste will be sucked into the vacuum cleaner through the powder sucking holes (501) and the air exhausting passage (1121) in the lower protrusion (112) as the vacuum cleaner operates.

Figure 7:
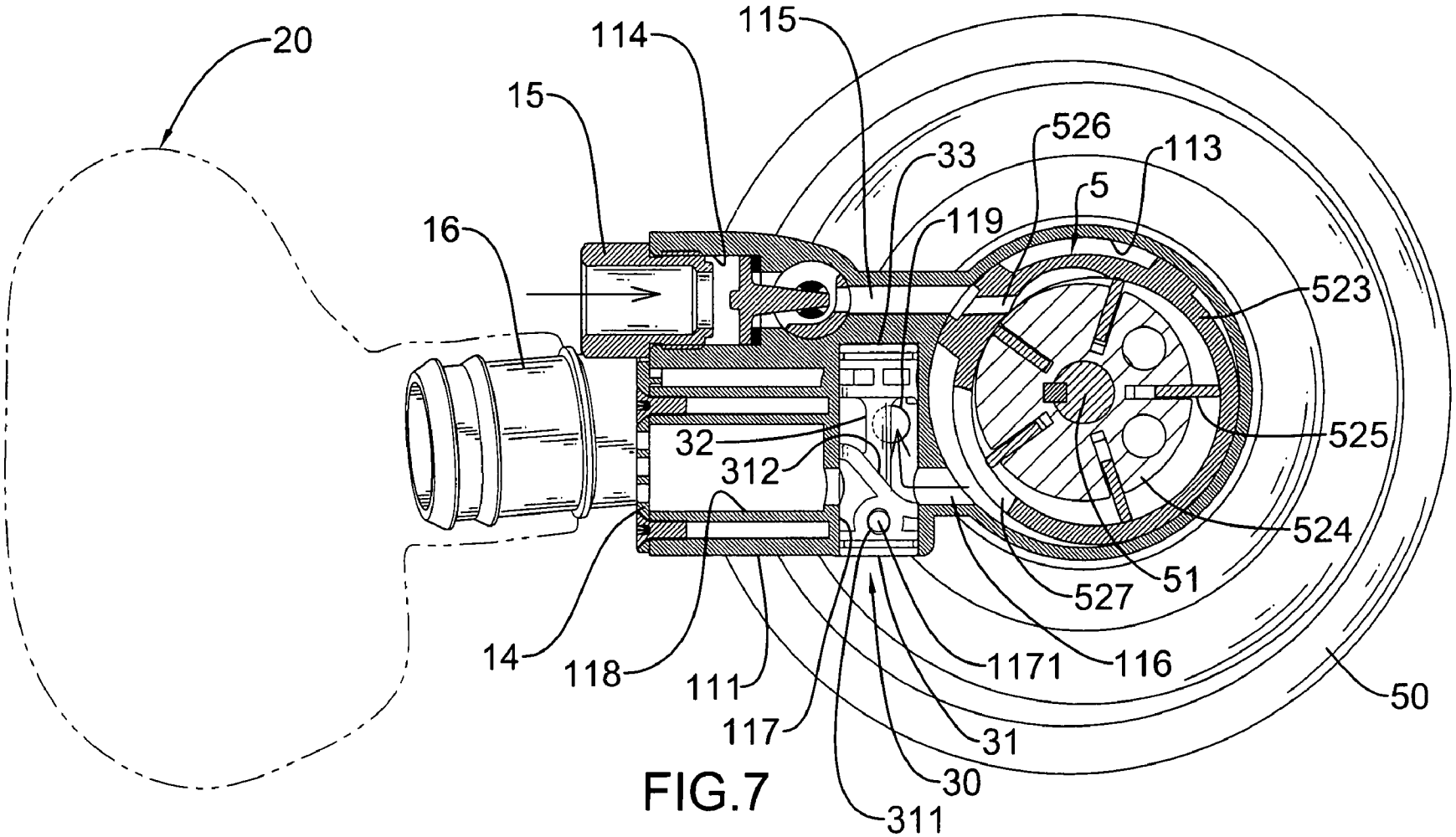
FIG. 7 is an operational, partial cross sectional top plan view of the sanding machine when the sanding machine is operated with a way of sucking the waste material into a dust bag.
Figure 8:
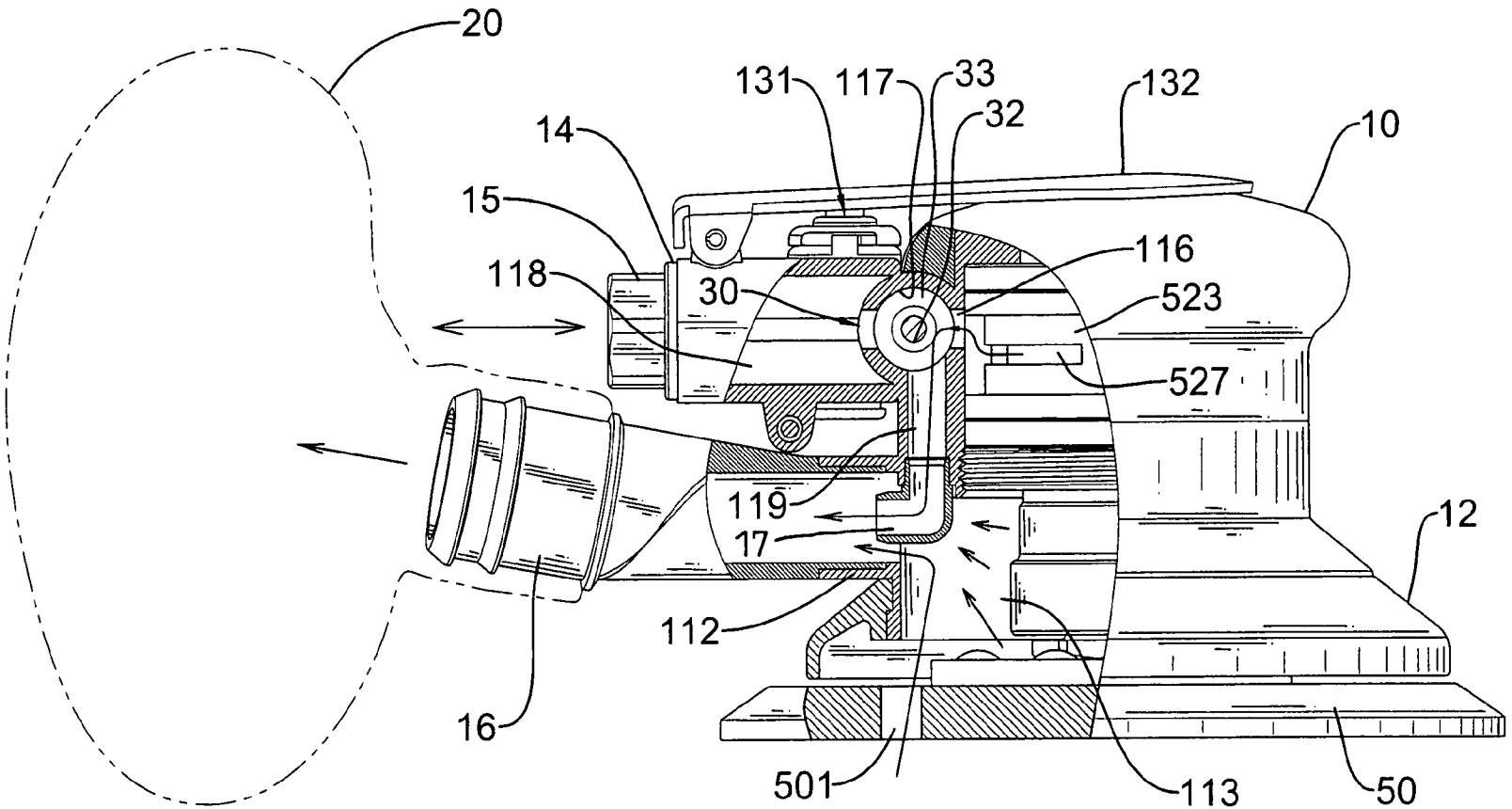
FIG. 8 is an operational, partial cross sectional side plan view of the sanding machine in FIG. 7.

With reference to FIGS. 3, 7 and 8, when the sanding machine has to be operated in the third way of using a dust bag (20) that connects to the vacuum connection fitting (16) to collect the waste material in the dust bag (20), the compressed air is used to not only rotate the motor (524), but also cause a sucking force to collection the dust. In such an operation model, the control valve (30) is taken out of the valve chamber (117). Then, the second portion (33) of the control valve (30) is inserted into the valve chamber (117) to uncover and open the connecting passage (119), thus the elongated covering protrusion of the first portion (31) covers and closes simultaneously the exhausted air passage (116). The pin (1171) is inserted into the pin hole (1172) and extends into the first positioning hole (311) to hold the control valve (30) in position. Thereafter, the compressed air that comes out of the rotor space through the air outlet (527) passes over the neck portion (32) and enters the connecting passage (119) and eventually travels into the air exhausting passage (1121) in the lower protrusion (112) through the air outlet of the elbow connection fitting (17) to cause a sucking force. The waste material is sucked by the force, moved through the powder sucking holes (501) and enters the dust bag (20) through the air exhausting passage (1121) in the lower protrusion (112).

Figure 9:
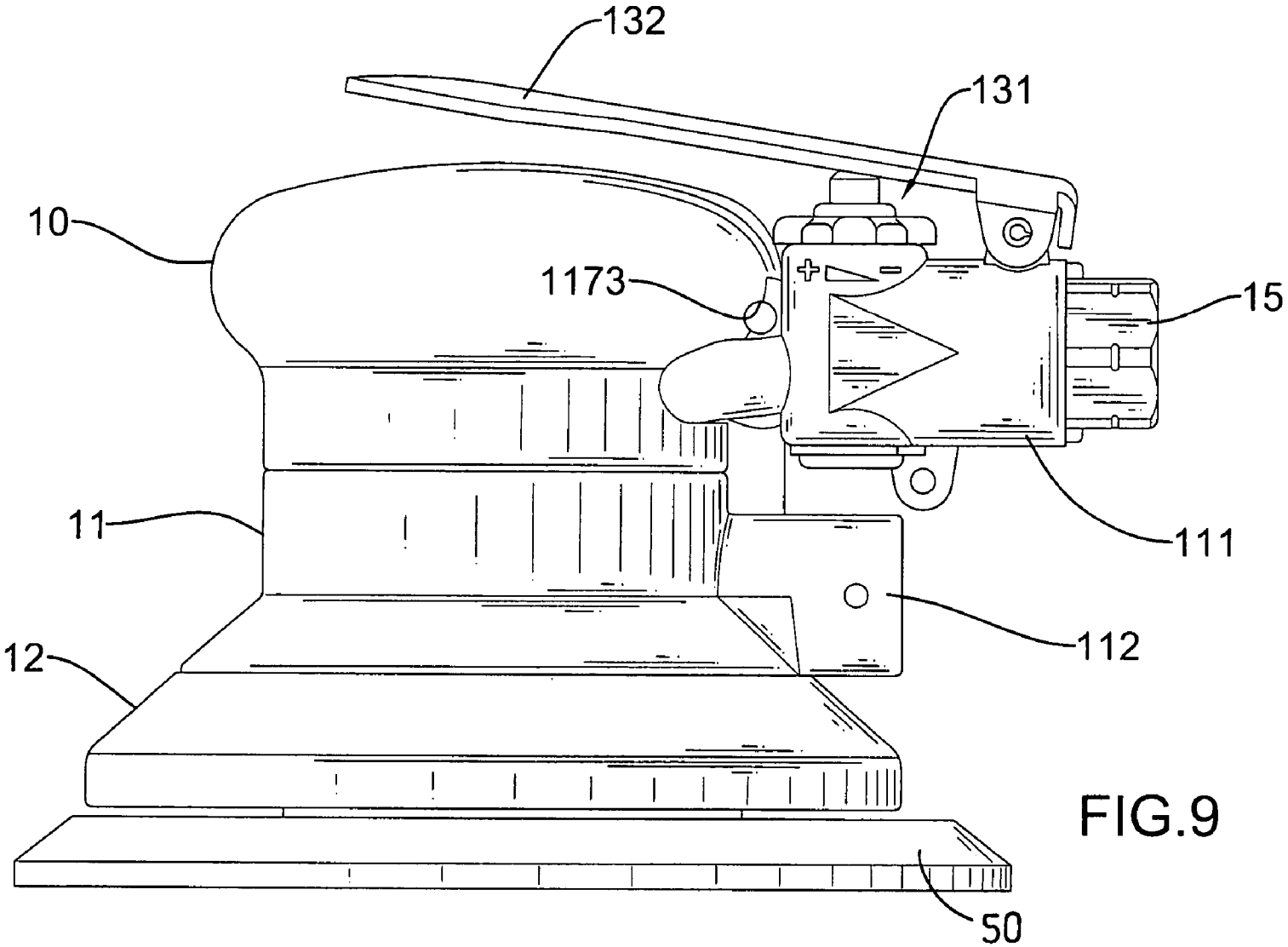
FIG. 9 is a side plan view of the sanding machine in FIG. 1.

Furthermore, with reference to FIGS. 2 and 9, the waste material will enter into the valve chamber (117) and may influence the control vale (30) to be smoothly taken out of the valve chamber (117) after a long-term use of the sanding machine. Therefore, the upper protrusion (111) further has a side bore (1173) defined in the other side of the upper protrusion (111) where the side bore (1173) is opposite to the valve chamber (117). The side bore (1173) communicates with the valve chamber (117) so that the person can conveniently use a stick (not shown) passing through the side bore (1173) to push the control valve (30) that is received in the valve chamber (117) out as the control valve (30) is engaged by the waste material.

The present invention simply uses the control valve (30) to control and change the flowing path of the compressed air in the sanding machine to change simultaneously the way to collect the waste material. The control valve (30) is easy to fabricate and convenient to use. Besides, since the sanding machine in accordance with the present invention has a selectable way of collection, the sanding machine is more economic than a conventional stand-alone sanding machine that has only one way of waste material collection.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the scope of the appended claims.

What is claimed is:

1. A pneumatic sanding machine comprising:

a body comprising a motor frame having an annular portion having an exterior periphery and an inner space with a top opening and a bottom opening;

an upper protrusion formed integrally on and extending from the exterior periphery of the annular portion and having a front formed integrally on the exterior periphery of the annular portion, a rear, two opposite sides, an intake air port and buffering chamber defined respectively in the rear of the upper protrusion, an intake air passage communicating with both the intake air port and the inner space of the annular portion, an exhausted air passage communicating with both the buffering chamber and the inner space of the annular portion, a valve chamber defined transversally in one of the sides of the upper protrusion to interconnect the exhausted air passage with the buffering chamber, a side bore defined in the other side of the upper protrusion and communicating with the valve chamber, and a connecting passage defined longitudinally in the valve chamber and having a bottom opening that communicates with the bottom opening of the inner space; and a lower protrusion formed integrally on the exterior periphery of the annular portion and having an air exhausting passage communicating with the inner space of the annular portion;

an elbow connection fitting fitted into and held in the bottom opening of the connecting passage and having an air outlet facing the lower protrusion and aligned with the air exhausting passage of the lower protrusion;

a bottom annular cover mounted to the annular portion of the motor frame; and a top cap covering the top opening of the inner space;

a pneumatic motor assembly mounted and held partially in the inner space in the motor frame and comprising a sanding pad having a top and multiple powder sucking holes defined through the top and covered by the bottom annular cover;

a shaft extending upwardly from the top of the sanding pad;

a pneumatic motor held in the inner space of the annular portion and having a stator mounted and held in the inner space in the motor frame and having a top, a bottom, a rotor space, an air inlet aligned and communicating with the intake air passage and an air outlet communicating with the exhausted air passage; and a rotor rotatably mounted in the rotor space of the stator and connecting to the shaft for rotating the shaft; and a control valve with a first end and a second end detachably received in the valve chamber and comprising a first portion that covers and closes selectively the connecting passage and the air exhausting passage of the lower protrusion, a second portion and a neck portion interconnecting the first portion with the second portion.

2. The pneumatic sanding machine as claimed in claim 1, wherein the first portion of the control valve further has an inclined surface facing the second portion, and the first portion forms an elongated covering protrusion that selectively covers the connecting passage and the air exhausting passage.

3. The pneumatic sanding machine as claimed in claim 2, wherein the body further comprises a chamber cover with multiple through holes that is mounted to the rear of the upper protrusion to cover the buffering chamber.

4. The pneumatic sanding machine as claimed in claim 1, wherein the body further comprises a switch assembly attached outside to the upper protrusion and comprising a pneumatic switch interconnecting the intake air port with the intake air passage and a lever pivotally mounted on the upper protrusion, whereby when the lever is pressed, the pneumatic switch is actuated to allow compressed air to enter the intake air passage through the intake air port.

5. The pneumatic sanding machine as claimed in claim 3, wherein the body further comprises a switch assembly attached outside to the upper protrusion and comprising a pneumatic switch interconnecting the intake air port with the intake air passage and a lever pivotally mounted on the upper protrusion, whereby when the lever is pressed, the pneumatic switch is actuated to allow compressed air to enter the intake air passage through the intake air port.

6. The pneumatic sanding machine as claimed in claim 5, wherein the body further comprises an intake air connection fitting fitted and held in the intake air port of the upper protrusion and a vacuum connection fitting fitted and held in the air exhausting passage of the lower protrusion.

7. The pneumatic sanding machine as claimed in claim 6, wherein the upper protrusion further has a pin hole communicating with the valve chamber;

the first and the second portions of the control valve each has a positioning hole selectively corresponding to the pin hole; and the body further comprises a pin held in the pin hole and extending out of the pin hole to selectively engage and be held in one of the positioning holes to hold the control valve in position.

* * * * *